US009858909B2

(12) United States Patent
Mizrahi et al.

(10) Patent No.: US 9,858,909 B2
(45) Date of Patent: Jan. 2, 2018

(54) DETECTING SYSTEM FOR A STRING INSTRUMENT

(71) Applicant: O.M.B. GUITARS LTD, Efrat (IL)

(72) Inventors: Shimon Mizrahi, Beit Shemesh (IL); Ben Zion Thee, Efrat (IL)

(73) Assignee: O.M.B. Guitars LTD, Efrat (IL)

( * ) Notice: Subject to any disclaimer, the term of this patent is extended or adjusted under 35 U.S.C. 154(b) by 0 days.

(21) Appl. No.: 15/265,859

(22) Filed: Sep. 15, 2016

(65) Prior Publication Data

US 2017/0004812 A1 Jan. 5, 2017

Related U.S. Application Data

(63) Continuation-in-part of application No. PCT/IL2015/050244, filed on Mar. 9, 2015.

(60) Provisional application No. 61/954,937, filed on Mar. 18, 2014, provisional application No. 62/381,025, filed on Aug. 30, 2016.

(51) Int. Cl.

| | |
|---|---|
| ***G10H 1/18*** | (2006.01) |
| ***G10H 1/34*** | (2006.01) |
| ***G10H 3/12*** | (2006.01) |

(52) U.S. Cl.

CPC ..... *G10H 1/342* (2013.01); *G10H 3/125* (2013.01); *G10H 2220/171* (2013.01)

(58) Field of Classification Search

CPC ..... G10H 1/342; G10H 2220/301; G10H 2220/171; G10H 3/18; G10H 1/34; G10H 2220/561; G10D 17/00; G10G 7/02

See application file for complete search history.

(56) References Cited

U.S. PATENT DOCUMENTS 3,340,343 A * 9/1967 Woll ..... G10H 1/02 327/117
3,871,247 A * 3/1975 Bonham ..... G10H 1/0008 84/115

(Continued)

FOREIGN PATENT DOCUMENTS

CA 2945916 A1 * 9/2015 ..... G10H 1/342

OTHER PUBLICATIONS

Written Opinion of International Searching Authority.

(Continued)

*Primary Examiner* — Marlon Fletcher
(74) *Attorney, Agent, or Firm* — PatShegen IP

(57) ABSTRACT

A detection system is provided for detecting a musical note played on a string instrument having a fretboard provided with a plurality of conductive frets and conductive strings. The system includes at least one conductor coupled to each of the frets; an inverter having a first terminal coupled to the conductor and a second terminal coupled to the conductive string, the inverter being configured to logically invert a signal transmitted therethrough, such that when the conductive string is pressed against one of the frets allowing thereby for a signal to be transmitted therethrough, the signal is sequentially inverted between two logical states at a frequency being dependent on the distance between the inverter and the fret; a frequency detector configured to measure the frequency; and a controller configured for determining the location of the fret along the fretboard in accordance with the frequency, and to thereby detect the musical note.

15 Claims, 3 Drawing Sheets

(56) References Cited

U.S. PATENT DOCUMENTS 3,902,395 A * 9/1975 Avant ..... G10H 1/182 84/647
4,321,852 A * 3/1982 Young, Jr. ..... G10H 1/182 84/646
4,336,734 A 6/1982 Polson
4,468,997 A * 9/1984 Young, Jr. ..... G10H 1/182 84/615
4,635,518 A 1/1987 Meno
5,162,603 A * 11/1992 Bunker ..... G10H 1/46 84/737
5,723,805 A * 3/1998 Lacombe ..... G10H 3/183 84/727
5,932,827 A * 8/1999 Osborne ..... G10H 3/18 84/726
5,990,411 A * 11/1999 Kellar ..... G10H 3/18 84/293
8,454,418 B2 6/2013 Chiu et al.
2010/0083807 A1* 4/2010 Sullivan ..... G10H 1/342 84/315
2010/0234109 A1* 9/2010 Chiu ..... A63F 13/06 463/37
2011/0218022 A1* 9/2011 Chiu ..... G06F 17/00 463/7
2012/0017748 A1 1/2012 Beck
2012/0036982 A1* 2/2012 Sullivan ..... G10H 1/383 84/724
2013/0180384 A1* 7/2013 Van Wagoner ..... G10G 1/02 84/485 R
2013/0247744 A1 9/2013 Helgesson
2017/0004812 A1* 1/2017 Mizrahi ..... G10H 1/342

OTHER PUBLICATIONS

Independent Search Report.
International Search Report.
Extended European Search Report.

* cited by examiner

DETECTING SYSTEM FOR A STRING INSTRUMENT

FIELD OF INVENTION

The present invention relates to a detecting system for a string instrument, in general, and in particular to a detecting system and a method for detecting and transmitting data representing played strings on a fretboard of a string instrument.

BACKGROUND

There are known several string instruments provided with a detecting system for detecting the note played. U.S. Pat. No. 4,635,518 discloses an electronic stringed musical instrument having an electrically insulating fingerboard is disclosed. The fingerboard is provided with a number of segmented frets attached across its upper surface at desired points along its length. Each of the frets includes a number of electrically conducting fret segments each of which are electrically insulated from one another. Any number of strings may be provided on the instrument each string is disposed adjacent to and associated with a single fret segment of each of the segmented frets. A top octave generator and octave dividers are utilized to selectively provide a fret segment of one of the frets with an electrical signal of at least one known referencing frequency. The strings are attached to the instrument in a spaced relationship with respect to the fret segments. Displacing a string to contact one of the fret segments completes an electrical circuit having at least one frequency equal to a frequency of the signal provided to that fret segment. Displacing the same string to contact a different fret segment completes a different electrical circuit having at least one different frequency. Simultaneously depressing a plurality of the strings simultaneously completes a number of electrical circuits each capable of producing a number of different frequencies. The amplitude output of the instrument is dependent upon the voltage applied to each of the strings and is controlled by hand operated transducers.

US2012017748 discloses a digital musical instrument including a fretboard and one or more strings extended over the fretboard. The instrument further includes an electric circuit for generating digital signals based on positions associated with contacts of the strings on the fretboard and a transceiver for transmitting the digital signals to a processing device that generates musical notation based on the digital signals.

U.S. Pat. No. 8,454,418 discloses a game controller having one or more strings is described for a computer gaming application. A plurality of frets can be disposed on a fingerboard and underlying the strings. The frets may include electrically conductive zones that can be electrically insulated from each other, and each zone corresponds to a different string. A polyphonic pickup having a plurality of wire-wound coils coupled to corresponding magnetic returns can be included, and can be adapted to detect striking of at least one of the strings by a user of the game controller. Output signals may be sent from the controller to the gaming application indicative of fingering of the game controller and the time at which the strings of the game controller are struck. Multi-mode apparatus are also described. A stringed apparatus may be used as both a game controller and an instrument.

WO2013109657 discloses an electronic stringed instrument practice device can be configured to perform one or more of the following:

detect when finger positions and/or string to fret contact on a finger or fret board forms an appropriate musical note or musical chord, visually indicate appropriate positions on a finger or fret board for forming a musical note or musical chord, and detect when strings have been selected (e.g., strummed). The electronic stringed instrument practice device can emit sound in the form of musical notes and chords. The electronic stringed instrument practice device can include communication modules for communicating with other computing devices, including mobile phones and tablets. The electronic stringed instrument practice device can interact with applications on other computing devices to further assist users in learning how to play a stringed musical instrument.

US2013247744 discloses a stringed instrument is equipped with an electrical conductor electrically connected to the frets mounted in the fretboard of said stringed instrument. Said stringed instrument is also equipped with a power source, light emitting members in electrical contact with the strings of the instrument (in one embodiment light emitting diodes) and electrical conductors electrically connecting together the components of the invention. By means of pressing down anyone of the strings capable of transmitting electric current against anyone of the frets capable of transmitting electric current connected to the electrical circuit comprised of said electrical components, said circuit closes and the light emitting member(s) associated with the string that is pressed down against the fret is lit.

JP2009271484 discloses a sensing means for sensing contact/non-contact is constituted by making a string and a fret in an electricity conductive state, and predetermined light is generated by a performance means interlocking with the sensing means, in a performance device for the string instrument.

SUMMARY OF INVENTION

There is provided in accordance with an aspect of the invention a fretboard of a string instrument in combination with a detecting system, the fretboard having a plurality of conductive frets disposed at various locations along its length and at least one conductive string extending over and spaced apart from the frets along the length of the fretboard. The detecting system includes a conductor disposed along the length of the fretboard coupled to each of the frets; an inverter having a first terminal coupled to the conductor and a second terminal coupled to the at least one conductive string and being configured to logically invert a signal transmitted therethrough such that when the at least one conductive string is pressed against one of the frets allowing thereby a signal to be transmitted therethrough, the signal is sequentially inverted between two logical states at a frequency dependent on the distance between the inverter and the fret; a frequency detector for measuring the frequency; and a controller for determining the location of the fret along the fretboard in accordance with the frequency.

The fretboard can include a plurality of conductive strings.

The conductor can include two conductors disposed with respect to each one of the plurality of conductive strings such that the average of the distance thereof from each of the plurality of conductive strings is equal for all of the plurality of conductive strings.

The conductive string can be configured to vibrate producing thereby a musical sound. The conductive string can includes a conductive material wound over of a nonconductive core. The conductive string and the plurality of conductive frets can be configured to allow transmitting therethrough a low voltage current such that is not affected by a user's finger. Each one of the plurality of conductive strings can be configured to receive a signal from the inverter.

The inverter can be configured for selecting one of many data-output-lines each of which being coupled to one of the plurality of conductive strings.

The combination can include a demultiplexer having an input configured for receiving an input signal from the inverter and an output configured for selecting one of many data-output-lines each of which being coupled to one of the plurality of conductive strings.

The inverter can be configured to invert an input voltage corresponding to a logical 1 to an output voltage of corresponding to a logical 0.

The combination can further include a controller being configured to detect which one of the plurality of conductive strings is being pressed against one of the plurality of frets.

The the controller and the frequency detector can be integrated in a CPU module.

The combination can further include an electronic component coupled to the inverter and configured to delay the signal thereby increasing the wavelength thereof. The electronic component can be a capacitor.

There is provided in accordance with another aspect of the invention a detection system for detecting a musical note played on a string instrument having a fret board provided with a plurality of conductive frets and at least one conductive string extending along thereof. The detection system includes at least one conductor coupled to each of the frets; an inverter having a first terminal coupled to the conductor and a second terminal coupled to the conductive string, the inverter being configured to logically invert a signal transmitted therethrough, such that when the conductive string is pressed against one of the frets allowing thereby for a signal to be transmitted therethrough, the signal is sequentially inverted between two logical states at a frequency being dependent on the distance between the inverter and the fret; a frequency detector configured to measure the frequency; and a controller configured for determining the location of the fret along the fretboard in accordance with the frequency, and to thereby detect the musical note.

The inverter can be configured to select one of many data-output-lines each of which being configured to be coupled to one conductive strings of a musical instrument having a plurality of conductive strings extending long the fretboard thereof.

The detection can further includes a demultiplexer having an input configured to receive an input signal from the inverter and an output configured for selecting one of many data-output-lines each of which being coupled to one of the plurality of conductive strings.

The first terminal of the inverter can be an input terminal and the second terminal is an output terminal. The inverter can be configured to invert an input voltage corresponding to a logical 1 to an output voltage of corresponding to a logical 0.

The detection system can further include a controller being configured to detect which one of the plurality of conductive strings is being pressed against one of the plurality of frets.

The detection system can further include a capacitor coupled to the inverter and being configured to form a signal resonance in the signal thereby delaying the signal for delaying the signal thereby increasing the wavelength thereof.

The detection system can further include a power source for generating a signal through the conductive string.

The detection system can further include a demultiplexer having an input configured for receiving an input signal from the inverter and an output configured for selecting one of many data-output-lines each of which being coupled to one of the plurality of conductive strings.

The inverter can be configured to select one of many data-output-lines each of which being configured to be coupled to one conductive strings of a musical instrument having a plurality of conductive strings extending long the fretboard thereof. The detection system can further include a demultiplexer having an input configured to receive an input signal from the inverter and an output configured to select one of many data-output-lines each of which being coupled to one of the plurality of conductive strings.

The detection system can further include a controller configured to detect which one of the plurality of conductive strings is being pressed against one of the plurality of frets.

The detection system can further include an electronic component coupled to the inverter configured to delay the signal thereby increasing the wavelength thereof. The electronic component is a capacitor configured to form a signal resonance in the signal thereby delaying the signal.

There is provided in accordance with yet another aspect of the invention a method for detecting a musical note played on a string instrument having a fretboard provided with a plurality of conductive frets each of which being coupled to a conductor, and at least one conductive string extending along the length of the fretboard. The method includes generating an electric signal through the conductive string, that can be transmitted through one of the frets when the conductive string is pressed against the fret; logically inverting the signal by an inverter having a first terminal coupled to the conductor and a second terminal coupled to the conductive string, such that when the conductive string is pressed against one of the frets allowing thereby the signal to be transmitted through the conductor, the signal sequentially inverted between two logical states at a frequency dependent on the distance between the inverter and the fret; detecting the frequency by a frequency detector; calculating the location of the fret along the fretboard in accordance with the frequency; and determining the musical note played on the instrument in accordance with the location.

There is provided in accordance with yet another aspect of the invention a detection system for detecting a musical note played on a string instrument having a fret board provided with a plurality of spaced apart conductive frets each of which being coupled to a conductor, and at least one conductive string extending over the frets. The detection system includes a power source for generating a signal through the conductive string; an inverter having a first terminal coupled to the conductor and a second terminal coupled to the conductive string; a frequency detector configured to measure the frequency; and a controller configured for determining the location of the fret along the fretboard in accordance with the frequency. The inverter being configured to logically invert a signal transmitted therethrough, such that when the conductive string is pressed against one of the frets allowing thereby for the signal to be transmitted therethrough, the signal is sequentially inverted between two logical states at a frequency being dependent on the distance between the inverter and the fret.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1:
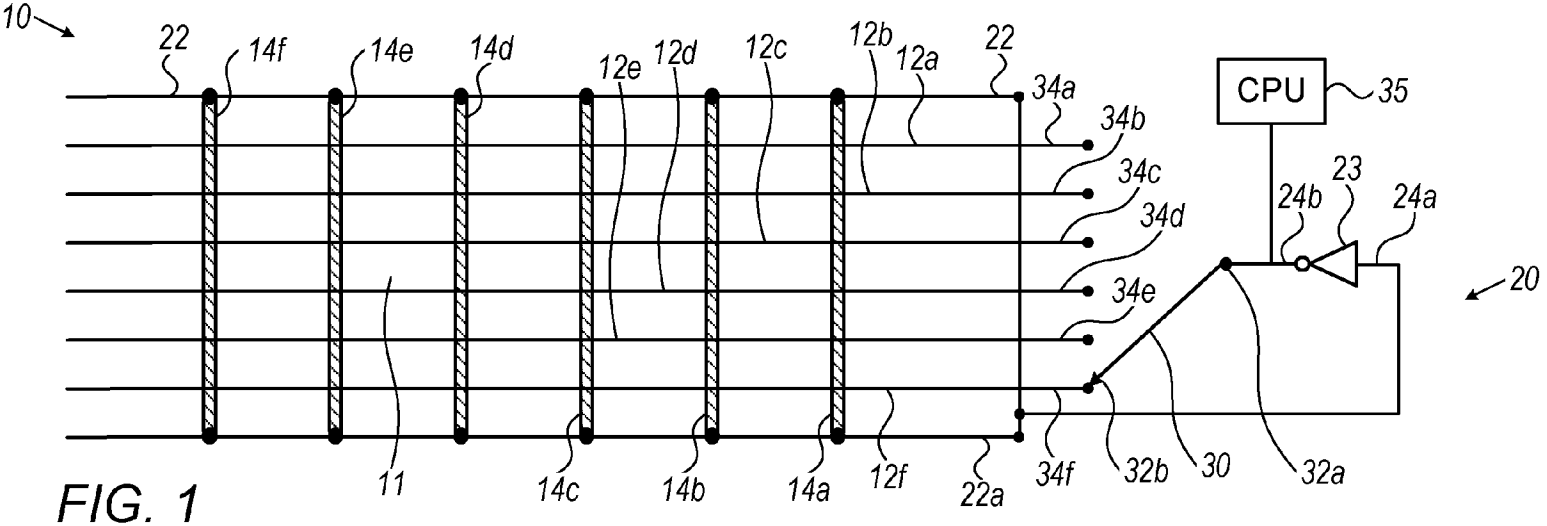
FIG. 1 is a block diagram of a fretboard and detecting system constructed and operative in accordance with an embodiment of the invention.

FIG. 1 shows a schematic illustration of a fret board 10 of a musical instrument (not shown) including a base board 11 having a plurality of conductive frets 14*a* through 14*f* transversely mounted thereon and a plurality of conductive strings 12*a*-12*f* extending along the length of the fretboard over the frets without touching them. The conductive strings 12*a*-12*f* and the conductive frets 14*a*-4*f* can be configured to allow transmitting through them a low voltage current, for example a current that is not sensed or affected by a user.

The conductive strings 14*a*-14*f* can vibrate freely, however controllably. The conductive strings 14*a*-14*f* can be made of a single material, such as steel, or can have a core of one material, over which is wound another materials, for example a core of plastic wound with a metal wire. In the latter case one or both materials are made of a conductive material.

It is appreciated that the number of strings and frets can vary in accordance with the requirements of the particular type of musical instrument on which the fretborad is mounted.

The fretboard 10 further includes a detecting system 20 configured for detecting the fret against which one of the strings 12*a*-12*f* is pressed, such that the chord or the note which is played can be detected.

The detecting system 20 includes at least one conductor 22 extending along the length of the fretboard 10 and being coupled to each of the frets 14*a*-14*f*. The conductor 22 can be integrated inside the base board 11 or can be mounted thereon.

Figure 2:
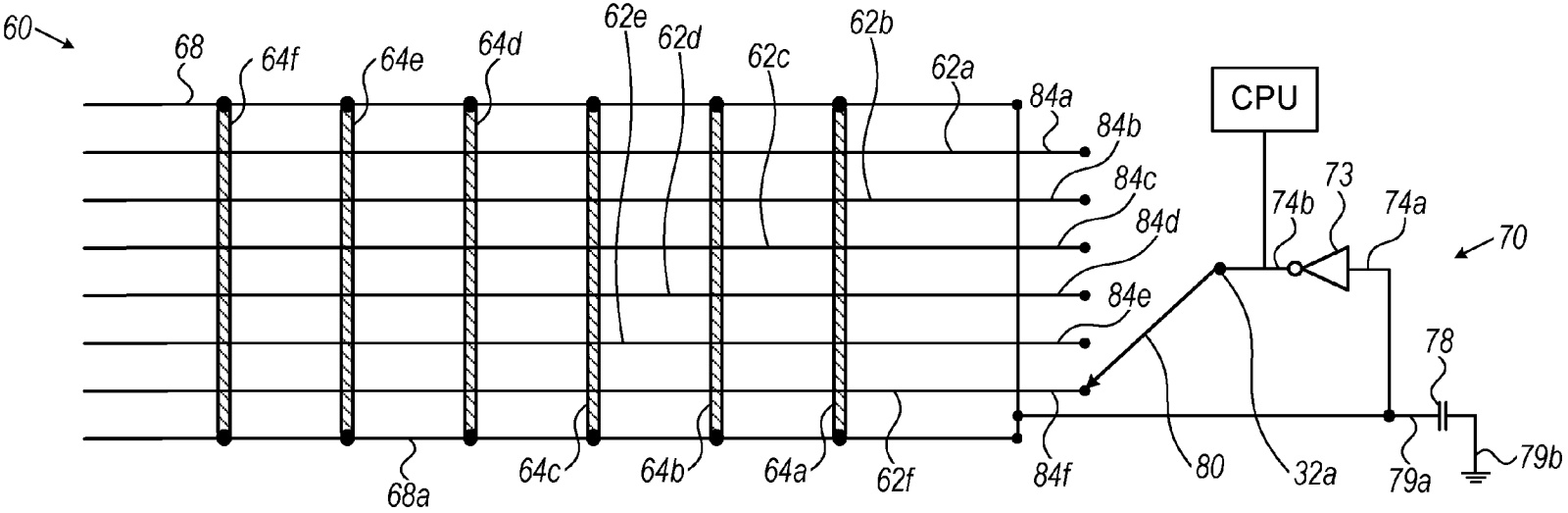
FIG. 2 is a block diagram illustration of a fretboard and detecting system constructed and operative in accordance with another embodiment of the invention.

The detecting system 20, includes a conductor 22, or two conductors 22, 22*a*, as illustrated in FIGS. 1 and 2 mounted on a side of the fretboard 10 such that each one of the frets 14*a*-14*f* is coupled at one end to a first conductor 22 and at the other end to the other conductor 22*a*. The advantage of having more than one conductor will be explained hereinafter.

The detecting system 20 further includes an inverter 23 (also known as a NOT logic) having an input terminal 24*a* and an output terminal 24*b* and is configured to output, at the output terminal 24*b*, a voltage representing the opposite logic-level than the voltage at the input terminal 24*a*. That is to say, if the input voltage corresponds to a logical 1 the output voltage of the inverter corresponds to a logical 0 and vice versa. The inverter can be any known inverter such as NC7SZ14 or the like or an inverting amplifier.

The input terminal 24*a* of the inverter 23 is coupled to the conductors 22, 22*a*, such that an electric signal therefrom can be logically inverted by the inverter 23. The output terminal 24*b* of the inverter 23 can be coupled to the strings 12*a*-12*f* such that the inverted signal can be transmitted thereto. Since it is desired to detect the fret against which the string is presses as well as to detect which of the strings 12*a*-12*f* is pressed, each of the strings 12*a*-2*f* can be individually and independently coupled to the inverter 23. This can be accomplished, for example, by having the strings 12*a*-12*f* coupled to the output terminal 24*b* of the inverter 23 by a demultiplexer 30 (also known as or demux). The demultiplexer 30 can include an input 32*a* configured to receive an input signal from the output terminal 24*b* of the inverter 23 and an output 32*b* configured to select one of many data-output-lines 34*a*-34*f* each of which is coupled to the terminal end of one of the strings 12*a*-12*f*.

The demultiplexer 30 can be configured to provide a cycle of instances, such that during each instance the output 32*b* thereof is coupled only to one of the data-output-lines 34*a*-34*f*. The output 32*b* can be configured to sequentially select one of the data-output-lines 34*a*-34*f* such that each one thereof sequentially receives a signal from the inverter 23. Since each one of the data-output-line 34*a*-34*f* is coupled to one of the conductive strings 12*a*-12*f*, the conductive strings 12*a*-12*f* are successively coupled, one at a time, to the output terminal 24*b* of the inverter 23 because of the operation of the demultiplexer 30, and an output signal can be transmitted therethrough. Alternatively the output terminal 24*b* of the inverter 23 can be coupled to strings 12*a*-12*f* through an analog switch such as the MAX459x, and the like.

The detecting system 20 further includes a frequency detector, configured to detect the frequency of the signal at the output terminal 24*b*, and a controller the purpose of which is discussed in detail herein below. The frequency detector and controller can be integrated in a CPU module 35 coupled to the output terminal 24*b* of the inverter 23. It will be appreciated that since the conductive strings 12*a*-12*f*, the conductor 22, and the inverter 23 form together an electric circuit the frequency detector can be coupled at any location thereof, i.e. at the output terminal 24*b*, the input terminal 24*a* or to the conductors 22, 22*a*.

The detection system further includes a power source (not shown) for generating an electric signal. The power source transmits electric signal through the conductive strings 12*a*-12*f* upon activation of the detection system.

As mentioned hereinabove, the frets 14*a*-14*f* are made of a conductive material, thus, pressing one of the conductive strings 12*a*-12*f* against one of the frets 14*a*-14*f*, facilitates closing a circuit formed by the respective conductive string, the conductors 22 and the inverter 23. For example, if conductive string 12*f* is pressed against fret 14*e*, the circuit is closed and an output signal is transmitted from the output terminal 24*b* of the inverter 23 through the demultiplexer 30, conductive string 12*f*, fret 14*e* and conductor 22 back to the input terminal 24*a*. If the voltage of the output signal corresponds to a logical 0, the voltage transmitted back through the conductive string 12*f* and the conductors 22 to the input terminal 24*a* corresponds to a logical 0 as well. As a response, the inverter 23 outputs an output signal having a voltage corresponding to a logical 1.

Further transmission of the output signal through the conductive string 12*f*, the fret 14*e* and the conductors 22 provides at the input terminal 24*a* a voltage corresponding to a logical 1, which is then inverted by the inverter 23 to a voltage at the output terminal corresponding to a logical 1.

The transmission of the output signal between the output terminal 24*b* and the input terminal 24*a*, continues so long as the conductive string 12*f* is pressed against the fret 14*e*. Accordingly, the signal transmitted through the conductive string 12*f* alternates between logical 1 and logical 1.

Figure 3:
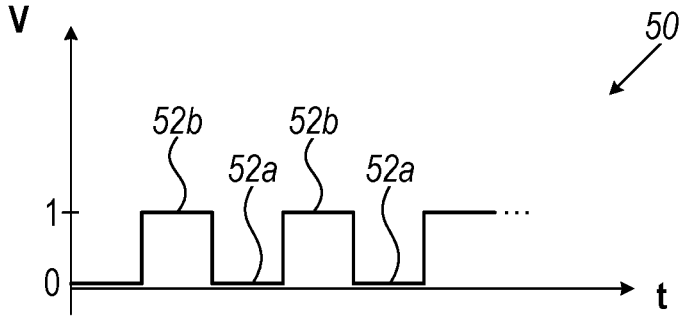
FIG. 3 is a graphic representation of an exemplary signal generated by the detecting system of FIG. 1.

As shown in the graph illustrated in FIG. 3 the output signal, can be represented as a square wave, generally designated 50, alternating between a first phase 52*a* in which the voltage thereof corresponds to a logical 0, and a second phase 52*b* in which the voltage thereof corresponds to a logical 1.

Alternation between the first phase 52*a* and the second phase 52*b* occurs at a frequency depending on the time interval between an inversion of the inverter 23 and the following inversion thereof. Since the inversions successively occurs once the current completes a full cycle between the output terminal 24*b* and the input terminal 24*a*, the time interval between each inversion is determined by the time required for the output signal 50 to travel from the output terminal 24*b* back to the input terminal 24*a* of the inverter 23.

Accordingly, the frequency of the wave 50, i.e the amount of times the phases 52*a* and 52*b* change within a given time unit, varies depending on the distance between the output terminal 24*a* and the fret against which the conductive string is pressed. That is to say, if conductive string 12*f* is pressed against fret 14*e*, the distance through which the output signal travels is less than the traveling distance when the conductive string 12*f* is pressed against fret 14*f*. Thus, the frequency of the signal formed when the conductive string 12*f* is pressed against fret 14*e* is higher than that which is formed when the conductive string 12*f* is pressed against fret 14*f*.

It is appreciated that since the output signal is transmitted through the conductive string 12*f* and back through the conductors 22, the actual traveling distance of the signal between the output terminal 24*b* back to the input terminal 24*a* is approximately twice the distance between inverter 23 and the fret against which the string is pressed.

The CPU module 35 contains a frequency detector that measures the frequency of the wave generated by the alternating signal, and can further detect a change in the frequency resulting from the change in the traveling distance of the signal, which occurs upon changing the frets 14*a*-14*f* upon which the strings 12*a*-12*f* are pressed. The CPU module 35 is thus configured to determine upon which fret a conductive string is pressed in accordance with the detected frequency.

If, for example, the signal travels at the speed of light (c), and the distance between the inverter 23 and the fret against which the string is pressed is d, the frequency of the square wave generated by the alternating output signal can be represented as:

$$F = \frac{1}{t_i + t_a},$$

where t, is the internal time delay of the inverter 23 and where $$t_0 = \frac{c}{2d}.$$

Accordingly, the pressure of strings 12*a*-12*f* against one of the frets 14*a*-14*f* can be detected since each fret defines a specific distance from the inverter 23 (d). It is appreciated that detection of the fret against which the conductive string is pressed can be carried out for any one of strings 12*a*-12*f*. However, since each one of strings 12*a*-12*f* is disposed at a different distance from the conductor 22, the varying distances may affect the frequency of the signal transmitted therethrough. Thus, as mentioned previously, the fretboard 10 can include two conductors 22 and 22*a*, disposed along the outer longitudinal edges of the fretboard 10 and joined together at the input terminal 24*a*. The two conductors 22, 22*a* are disposed with respect to each one of the conductive strings 12*a*-12*f* such that the average of the distance thereof from each of the conductive strings 12*a*-12*f* is equal for all of the conductive strings. Thus, the two conductors 22, 22*a* provide a signal averaging, facilitating thereby an accurate detection of the frequency changes resulting from the varying distances between the inverter 23 and the fret against which the string is pressed.

According to a different example, a single conductor 22 can be used, the CPU however can be configured to detect the string which is being pressed and to calculate thereby the frequency, taking into consideration the distance between the string and the conductor 22. Detecting the string which is being pressed can be carried out for example by a pressure detector, or by receiving feedback from the demultiplexer 30. That is to say, the signal is transmitted back to the input terminal 24*a* only when the demultiplexer 30 is coupled to a conductive string which is currently being pressed. Thus, the demultiplexer 30 can provide the CPU with the data regarding the string which is being pressed, such that the fret against which is being pressed can be detected in accordance with the frequency of the signal taking into consideration the distance between string and the conductor 22.

It is appreciated that the inverter 23 the demultiplexer 30, the CPU or any other electronic components can be disposed at any location on a string instrument. For example these electronic components can be integrated in a module which can be coupled to a string instruments, for example via a dedicated interface on the instrument. This way, a module can be coupled to a string instrument when the user wishes to receive indication regarding the notes and chords being played.

FIG. 2 is a block diagram of a fretboard 60 and detecting system 70 in accordance with another example of the invention. The fretboard 60 is substantially the same as the fretboard 10 of FIG. 1 and includes a plurality of conductive strings 62*a*-62*f* and a plurality of frets 64*a*-64*f* coupled to one or more conductors 68, 68*a*. Similarly, the detecting system 70 is substantially the same as the detecting system 20 of FIG. 1, and includes an inverter 73 having an input terminal 74*a*, an output terminal 74*b* and a demultiplexer 80 configured for selecting one of many data-output-lines 84*a*-84*f* each of which being coupled to one of the conductive strings 62*a* through 62*f*.

According to the present example, the detecting system 70 further includes a capacitor 78 coupled to an input terminal 74*a* of the inverter 73. The capacitor 78 is configured such that a signal transmitted through the conductors 68, 68*a*, charge the capacitor which in return charges back the conductors, thus forming a resonance therebetween. The resonance is in the form of an electric oscillation created by the interaction between the capacitor 78, the conductor 68 and the conductive string which is being pressed against one of the frets 64*a*-64*f*. Due to the resistance of the conductors 68,68*a* and the conductive string 62*a*-62*f*. The electric oscillation is decayed following which the signal reaches the input terminal 74*a* of the inverter 73. When the signal enters the inverter 73 the signal is inverted. For example, if the signal at the input terminal 74*a* is at a voltage corresponding to a logical 1, the inverter 73 inverts to the signal to the opposite logic-level thereof, i.e. 0, as explained hereinabove with respect to FIGS. 1 and 3.

Similar oscillation occurs when the voltage corresponding to a logical 0 is transmitted through the conductive string and the conductors 68. The electric oscillation is decayed following which the logical 0 signal reaches the input terminal 74*a* of the inverter 73 where it is inverted back to logical 1.

Figure 4:
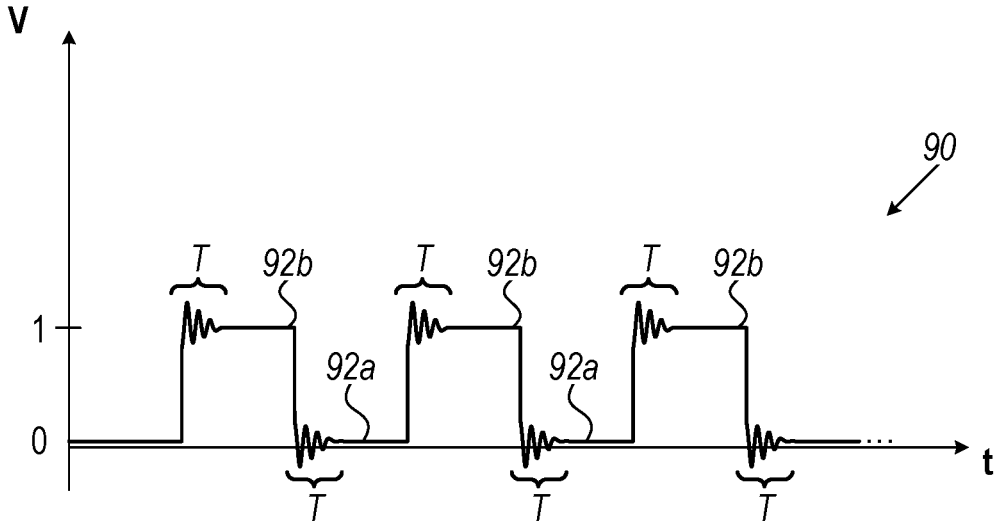
FIG. 4 is a graphic representation of an exemplary signal generated by the detecting system of FIG. 2.

Thus, as shown in the graph of FIG. 4, the signal can be represented as a square wave, generally designated 90, alternating between a first phase 92*a* in which the voltage thereof corresponds to a logical 0, and a second phase 92*b* in which the voltage thereof corresponds to a logical 1. Each one of the first and second phases 92*a* and 92*b* includes a decay time, which can be represented as T, which increases the wavelength of the signal at 2T, due to the fact that the oscillation occurs twice in each wavelength, i.e. one time for the logical 0 phase and a second time for the logical 1 phase. This results in a signal having larger wavelength, i.e. having a lower frequency, such that detecting minor frequency changes is facilitated.

It is appreciated that according to other examples the detecting system can include other electronic component for delaying the signal thereby increasing the wavelength, for example a serial inductor or delay line.

Figure 5:
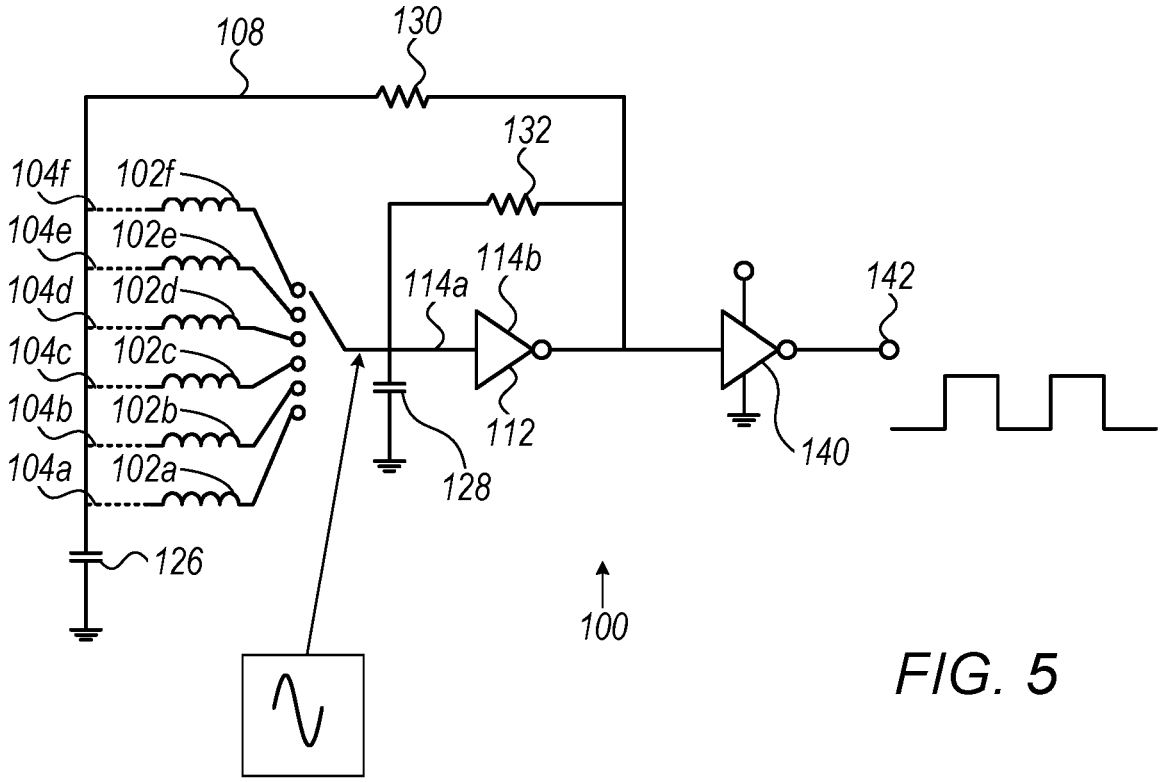
FIG. 5 is a block diagram illustration of an electric circuit for a detecting system constructed and operative in accordance with yet another embodiment of the invention.

FIG. 5 shows an electric circuit 100 according to another example of the presently disclosed subject matter. The circuit 100 according to this example, can be configured to generate a substantially sine electric signal, as opposed to a square electric signal. For example, the circuit can be an electronic oscillator such as a colpitts oscillator. That is to say, the circuit 100 can include plurality of conductive strings 102*a*-102*f* and a plurality of frets 104*a*-104*f* coupled to at least one conductor 108. The circuit 100 can further include an inverter 112 having an input terminal 114*a*, an output terminal 114*b* and a demultiplexer 120 configured for selecting one of the conductive strings 102*a* through 102*f*.

According to the present example, the circuit 100 further includes a capacitor 128 coupled to an input terminal 114*a* of the inverter 112, and an additional capacitor 126 coupled to the conductor 108. The additional capacitor 126 can be configured such that a signal transmitted through the conductors 108, charges the capacitor 126 which in return charges back the conductors, thus forming a resonance therebetween.

The resistors 130 and 132 together with capacitors 128 and 126 are configure to form a sine signal when one of the strings is engaged with one of the frets 104*a*-104*f*. Forming the sine signal precludes noises and interferences associated with high frequencies included in the square signal.

The circuit 100 can further include an additional transistor 140 coupling the output terminal 114*b* of the invertor 112 and a frequency detector 142, and is configured to form a substantially square signal at the frequency detector 142, facilitating thereby the detection of the frequency.

Those skilled in the art to which the presently disclosed subject matter pertains will readily appreciate that numerous changes, variations, and modifications can be made without departing from the scope of the invention, mutatis mutandis.

The invention claimed is:

1. A detection system for detecting a musical note played on a string instrument having a fret board provided with a plurality of conductive frets and at least one conductive string extending along thereof, the detection system comprising:

at least one conductor coupled to each one of said frets;

an inverter having a first terminal coupled to said conductor and a second terminal coupled to the conductive string, said inverter being configured to logically invert a signal transmitted therethrough, such that when the conductive string is pressed against any one of said frets allowing thereby for a signal to be transmitted therethrough, said signal is sequentially inverted between two logical states at a frequency being dependent on the distance between said inverter and said fret;

a frequency detector configured to measure said frequency; and, a controller configured for determining the location of said fret along the fretboard in accordance with said frequency, and to thereby detect the musical note.

2. The detection system according to claim 1, wherein said inverter is configured to select one of many data-output-lines each of which being configured to be coupled to one conductive strings of a musical instrument having a plurality of conductive strings extending long the fretboard thereof.

3. The detection system according to claim 2, further comprising a demultiplexer having an input configured to receive an input signal from said inverter and an output configured for selecting one of many data-output-lines each of which being coupled to one of said plurality of conductive strings.

4. The detection system according to claim 2, wherein said first terminal of said inverter is an input terminal and said second terminal is an output terminal wherein said inverter is configured to invert an input voltage corresponding to a logical 1 to an output voltage of corresponding to a logical 0.

5. The detection system according to claim 2, further comprising a controller being configured to detect which one of said plurality of conductive strings is being pressed against one of the plurality of frets.

6. The detection system according to claim 1, further comprising a capacitor coupled to said inverter and being configured to form a signal resonance in said signal thereby delaying the signal for delaying the signal thereby increasing the wavelength thereof.

7. A detection system according to claim 2, further comprising a demultiplexer having an input configured for receiving an input signal from said inverter and an output configured for selecting one of many data-output-lines each of which being coupled to one of said plurality of conductive strings.

8. The detection system according to claim 2, wherein said inverter is configured to select one of many data-output-lines each of which being configured to be coupled to one conductive strings of a musical instrument having a plurality of conductive strings extending long the fretboard thereof.

9. The detection system according to claim 8, further comprising a demultiplexer having an input configured to receive an input signal from said inverter and an output configured to select one of many data-output-lines each of which being coupled to one of said plurality of conductive strings.

10. The detection system according to claim 2, further comprising a controller configured to detect which one of said plurality of conductive strings is being pressed against one of the plurality of frets.

11. The detection system according to claim 1, further comprising a capacitor configured to form a signal resonance in said signal thereby delaying the signal and increasing the wavelength thereof.

12. The detection system according to claim 1 wherein said at least one conductor includes two conductors disposed with respect to each one of said plurality of conductive strings such that the average of the distance thereof from each of said plurality of conductive strings is equal for all of said plurality of conductive strings.

13. A method for detecting a musical note played on a string instrument having a fretboard provided with a plurality of conductive frets each of which being coupled to a conductor, and at least one conductive string extending along the length of the fretboard, the method comprising:

generating an electric signal through the conductive string, that can be transmitted through one of the frets when the conductive string is pressed against the fret;

logically inverting the signal by an inverter having a first terminal coupled to the conductor and a second terminal coupled to the conductive string, such that when the conductive string is pressed against one of said frets allowing thereby said signal to be transmitted through the conductor, said signal sequentially inverted between two logical states at a frequency dependent on the distance between said inverter and said fret;

detecting said frequency by a frequency detector;

calculating the location of the fret along the fretboard in accordance with said frequency; and, determining the musical note played on the instrument in accordance with said location.

14. A fretboard of a string instrument in combination with a detecting system, said fretboard having a plurality of conductive frets disposed at various locations along its length and at least one conductive string extending over and spaced apart from the frets along the length of the fretboard; said detecting system comprising:

a conductor disposed along the length of the fretboard coupled to each one of said frets;

an inverter having a first terminal coupled to said conductor and a second terminal coupled to said at least one conductive string and being configured to logically invert a signal transmitted therethrough such that when said at least one conductive string is pressed against any one of said frets allowing thereby a signal to be transmitted therethrough, said signal is sequentially inverted between two logical states at a frequency dependent on the distance between said inverter and said fret;

a frequency detector for measuring said frequency; and, a controller for determining the location of said fret along the fretboard in accordance with said frequency.

15. The combination of claim 14, wherein said conductive string is configured to receive a signal from said inverter and configured to allow transmitting therethrough a low voltage current such that is not affected by a user's finger.

* * * * *